US005562975A

United States Patent [19]

Sugai et al.

[11] Patent Number: 5,562,975

[45] Date of Patent: Oct. 8, 1996

[54] HOT MELT INK THERMAL TRANSFER RECORDING SHEET

[75] Inventors: Masaaki Sugai, Nishinomiya; Norihito Izumi, Tokyo, both of Japan

[73] Assignee: New Oji Paper Co., Ltd., Tokyo, Japan

[21] Appl. No.: 499,136

[22] Filed: Jul. 7, 1995

[30] Foreign Application Priority Data

Jul. 11, 1994 [JP] Japan ..... 6-158787

[51] Int. Cl.[6] ..... B41M 5/025

[52] U.S. Cl. ..... 428/212; 428/195; 428/206; 428/207; 428/331; 428/520; 428/910; 428/913; 428/914

[58] Field of Search ..... 428/195, 206, 428/207, 212, 331, 520, 910, 913, 914

[56] References Cited

FOREIGN PATENT DOCUMENTS

| | | |
|---|---|---|
| 0423829 | 4/1991 | European Pat. Off. . |
| 61-27292 | 2/1986 | Japan . |
| 62-160277 | 7/1987 | Japan . |
| 63-19289 | 1/1988 | Japan . |
| 5-131766 | 5/1993 | Japan . |

OTHER PUBLICATIONS

Database WPI; Derwent Publ. Ltd., London, GB; Class A89, AN 91–145509 & JP A–03 082 589; 8 Apr. 1991, Abstract.

Database WPI; Derwent Publ. Ltd., London, GB; Class A89, AN 94–053790 & JP A–06 008 659; (Daio Seishi KK), 18 Jan. 1994, Abstract.

Patent Abstracts of Japan; vol. 12, No. 141 (M–691), 28 Apr. 1988 & JP A–62 259882 (Mitsubishi Paper Mills Ltd) 12 Nov. 1987, Abst.

Japanese Industrial Standard; "Methods of Test for Pigments"; JIS K 5101; Dated 1991.

*Primary Examiner*—Bruce H. Hess

*Attorney, Agent, or Firm*—Armstrong, Westerman, Hattori, McLeland & Naughton

[57] ABSTRACT

A hot melt ink thermal transfer recording sheet, capable of recording clear continuous tone hot melt ink images thereon, is formed by coating a multi-layered substrate comprising a plurality of mono- or di-axially oriented thermoplastic resin film with an ink-receiving layer including a mixture of a modified polyvinyl alcohol containing silanol groups and having a polymerization degree of 1000 to 2000 with fine amorphous silica having an oil absorption of 200 to 300 ml/100 g (JIS K5101) and an average particle size of 0.5 to 4.0 μm determined by the Coulter Counter method.

2 Claims, No Drawings

HOT MELT INK THERMAL TRANSFER RECORDING SHEET

BACKGROUND OF THE INVENTION

1. Field of the Invention

The present invention relates to a hot melt ink thermal transfer recording sheet. More particularly, the present invention relates to a hot melt ink thermal transfer recording sheet useful for recording thereon clear dotted ink images with a high dot reproducibility, while the occurrence of missing or partial dots is prevented by using a hot melt ink thermal transfer printer provided with a thermal head.

2. Description of the Related Art

The basic mechanism of the hot melt ink thermal transfer recording is that an ink ribbon having a thermally fusible ink coating is superimposed on a recording sheet capable of receiving thereon the ink, the superimposed ribbon and sheets are pressed between a platen roll and a thermal head under an appropriate pressure, and a resistive exothermic member arranged in the thermal head generates heat in accordance with electric signals applied thereto so that the ink ribbon is locally heated imagewise and the melted ink images are thermally transferred to the recording sheet. In this thermal transferring operation, derived colored images can be obtained by superimposing single colored hot melt inks different from each other on each other.

The hot melt ink thermal transfer recording system has a simple mechanism and can be easily maintained. Therefore, this recording system is widely utilized as a printer of word processors and facsimile machines.

Recently, to obtain a higher continuous tone reproducibility of printed images than that of conventional dither systems, printing systems are now utilizing an area continuous tone image-forming system in which the size of individual printing dots is changed to provide multiple continuous tones of images or a color density continuous tone image-forming system in which the size of individual printing dots is not changed but the color density of the individual printing dots is changed to provide multiple continuous tones of images.

Also, the ink image-recording sheet is required to be able to accurately receive the hot melt ink dots with a high reproducibility in a full color recording system in wide range of from low energy applications to high energy applications.

When a conventional recording sheet is used for the area continuous tone printing system or the color density continuous tone printing system, to obtain the multiple continuous tone images, portions of the printed images applied with low energy are unclear because of frequent occurrence of missing and/or partial dots.

Under these circumstances, Japanese Unexamined Patent Publication (Kokai) No. 62-160,277 discloses an attempt to prevent printing errors such as missing or partial dots, by adding a silica pigment having a high oil absorption to the ink-receiving layer. However, when the silica pigment is fixed with a conventional binder, for example, water-soluble polymeric material or an aqueous emulsion of water-insoluble polymeric material, the resultant ink-receiving layer exhibits a low bonding strength and thus when the ink ribbon is peeled off from the recording sheet after the thermal transfer printing operation is completed, the transferred ink layer is separated together with the ink ribbon from the recording sheet. The reasons for this phenomenon are not completely clear. However, it is assumed that the conventional polymeric material is adsorbed in fine pores formed in the surface portions of the silica pigment particles.

SUMMARY OF THE INVENTION

An object of the present invention is to provide a hot melt ink thermal transfer recording sheet capable of recording thereon clear dotted ink images, when used for a hot melt ink thermal transfer printer in which multiple continuous tone images are formed by an area continuous tone image-forming system or a color density continuous tone image-forming system, while missing or partial dots are restricted, over a wide range of application energy from low energy to high energy.

Another object of the present invention is to provide a hot melt ink thermal transfer recording sheet capable of recording thereon clear dotted ink images transferred from an ink ribbon without releasing the transferred ink layer from the recording sheet.

The inventors of the present invention made intensive studies to attain the above-mentioned objects and found that a hot melt ink thermal transfer recording sheet capable of recording thereon clear dotted ink images in which printing errors, namely missing or partial dots are reduced over a wide range of application energies, without releasing the printed ink layers, can be prepared by coating a substrate sheet made from a diaxially oriented multilayered polymeric film comprising, as a principal component, a mixture of a polyolefin resin with an inorganic pigment, with an ink-receiving layer comprising a silicon-containing, modified polyvinyl alcohol having a polymerization degree of 1000 to 2000 and an inorganic pigment comprising fine amorphous silica particles having an oil absorption of 200 to 300 ml/100 g and an average particle size of 0.5 to 4.0 μm.

Namely, the hot melt ink thermal transfer recording sheet of the present invention comprises:

a multilayered substrate sheet comprising a plurality of resin films laminated on each other, each comprising, as a principal component, a mixture of a polyolefin resin with an inorganic pigment, and each oriented monoaxially or diaxially; and an ink-receiving layer formed on a surface of the substrate sheet and comprising, as a principal component, a mixture of a resinous material with an inorganic pigment, wherein the resinous material for the ink-receiving layer comprises a modified polyvinyl alcohol provided with silanol groups and having a degree of polymerization of 1,000 to 2,000, and the inorganic pigment for the ink-receiving layer comprises fine amorphous silica particles having an oil absorption of 200 to 300 ml/100g determined in accordance with Japanese Industrial Standard (JIS) K5101 and an average particle size of 0.5 to 4.0 μm determined by the Coulter Counter method.

DESCRIPTION OF THE PREFERRED EMBODIMENTS

In the recording sheet of the present invention, the inorganic pigment for the ink-receiving layer comprises fine amorphous silica particles having an oil absorption of 200 to 300 ml/100g and an average particle size of 0.5 to 4.0 μm. The oil absorption is measured in accordance with JIS K5101, and the average particle size is measured by the Coulter Counter method using a Coulter Counter (Ap tube 50 μm) made by Shimazu Seisakusho (K.K.).

The oil absorption of 200 to 300 ml/100 g enables the amorphous silica particles to exhibit a high and stabilized adhesion to a thermally melted ink. Also, the average particle size of 0.5 to 4 μm effectively contributes to forming fine pores among the pigment particles, the fine pores cause the melted ink-absorption and adhesion of the resultant ink-receiving layer to increase and to be stabilized. If the oil absorption is more than 300 ml/100 g, however, the polymeric component in the coating liquid for forming the ink-receiving layer is absorbed in a large amount in the fine pores among the fine silica particles, and thus the resultant ink-receiving layer exhibits an unsatisfactory mechanical strength. Also, if the oil absorption is less than 200 ml/100 g, the resultant ink-receiving layer exhibits an unsatisfactory adhesion to the melted ink and thus the target effect of the present invention cannot be attained.

The resinous material for the ink-receiving layer comprises a modified polyvinyl alcohol containing silanol groups and having a degree of polymerization of 1,000 to 2,000. The silanol groups of the modified polyvinyl alcohol chemically react with the silica pigment so as to enhance the mechanical strength of the ink-receiving layer. The silanol group-containing modified polyvinyl alcohol has a degree of polymerization of 1,000 to 2,000. If the degree of polymerization is more than 2,000, the resultant modified polyvinyl alcohol exhibits a decreased coating property. Also, if the degree of polymerization is less than 1,000, the resultant ink-receiving layer exhibits an unsatisfactory mechanical strength.

The resinous material for the ink-receiving layer optionally contains, in addition to the silanol group-containing, modified polyvinyl alcohol, an additional polymeric material selected from water-soluble polymeric materials, for example, oxidized starch, etherified starch, methoxy cellulose, carboxymethyl cellulose, hydroxyethyl cellulose, casein, soybean protein, polyvinyl pyrrolidon, polyacrylamide, and polyacrylic acid; and water-insoluble polymeric materials, for example, vinyl chloride copolymer resins, poly-vinylidene chloride, vinyl chloride-vinylidene chloride copolymer resins, acrylic acid ester copolymer resins, methacrylic acid ester copolymer resins, butyral resins, silicone resins, polyester resins, vinylidene fluoride resins, nitrocellulose resins, styrene resins, styrene-acrylic copolymer resins, styrene-butadiene copolymer resins, which are used in the state of a solution or emulsion. The above-mentioned polymeric materials can be employed alone or in a mixture of two or more thereof, together with the silane group-containing, modified polyvinyl alcohol.

In the ink-receiving layer, the silica particles may be employed together with an additional pigment selected from inorganic pigments, for example, zinc oxide, titanium dioxide, calcium carbonate, clay, talc, mica, calcined (dehydrated) clay, aluminum hydroxide, barium sulfate, and lithophone; and organic pigments, for example, powders or beads of polystyrene, polyethylene, polypropylene, epoxy resins, melamine resins, phenol resins, and styrene-acrylic copolymer resins, a starch powder, a cellulose powder, and microspheres of vinylidene chloride copolymer resins. The above-mentioned additional pigments may be employed alone or in a mixture of two or more thereof, together with the silica pigment.

In the ink-receiving layer, the silanol group-containing, modified polyvinyl alcohol is preferably present in an amount of 1 to 70 parts by weight, more preferably 15 to 50 parts by weight, per 100 parts of the silica pigment. If the silanol group-containing, modified polyvinyl alcohol is used in an amount less than one part by weight per 100 parts by weight of the silica pigment, the resultant ink-receiving layer may exhibit an unsatisfactory mechanical strength. If the amount of the silanol group-containing, modified polyvinyl alcohol in the ink-receiving layer is more than 70 parts by weight per 100 parts by weight of the silica pigment, the fine pores formed among the fine silica particles are occupied by the silanol group-containing, modified polyvinyl alcohol and thus the resultant ink-receiving layer may exhibit an unsatisfactory absorption of the melted ink.

The silica pigment, the silanol-containing, modified polyvinyl alcohol and the optional additional polymeric material and additional pigment can be converted to a coating liquid by a conventional method. Namely, the polymeric material or its solution is mixed with the pigments or its dispersion to provide a coating liquid.

The ink-receiving layer can be formed by coating a surface of the substrate sheet with the coating liquid by a conventional coating method, for example, the mayer bar coating method, gravure roll. coating method, reverse roll coating method, blade coating method, knife coating method, air knife coating method, slit die coating method, and dry-solidifying the coated liquid layer.

To provide an ink-receiving layer having a satisfactory performance, it is preferable that the coating liquid is coated to form the ink receiving layer with a dry weight of 4 to 15 $g/m^2$. The multilayered substrate sheet usable for the present invention comprises a plurality of thermoplastic resin films laminated on each other, each comprising, as a principal component, a mixture of a polyolefin resin with an inorganic pigment and each oriented monoaxially or diaxially, in the other words, in a longitudinal and/or transversal direction of the films. The polyolefin resin may be selected from polyethylene resins and polypropylene resins. The inorganic pigment may be selected from calcium carbonate; titanium dioxide and silica pigments.

The multilayered sheet includes a three-layered sheet comprising a base film made from a mixture of a polyolefic resin with an inorganic pigment, and monoaxially or diaxially oriented paper-like front and back film layers laminated on the front and back surfaces of the base film, and four or more layered sheets comprising the same base and front and back paper-like film layers as mentioned above and at least one additional layer, for example, an outermost surface layer having an enhanced whiteness and laminated on the front paper-like film layer.

The oriented multilayered sheet as mentioned above is known as a synthetic paper sheet and includes opaque paper-like sheets and semi-transparent tracing paper-like sheets.

The transparency (clarity) of the sheet is variable in response to the type and content of the pigment.

The thermoplastic resin for the substrate sheet comprises, as a principal component, a polyolefin resin, for example, polyethylene resin, polypropylene resin, ethylene-propylene copolymer resin or ethylene-vinyl acetate copolymer resin.

The thermoplastic resin may be mixed with a polystyrene or polyacrylic acid ester copolymer.

The inorganic pigment to be mixed into the thermoplastic resin for the base film layer and paper-like film layers of the substrate sheet may be selected from, for example, calcium carbonate, dehydrated clay, diatomaceous earth, talc, and silica each having an average particle size of 20 μm or less. The outermost surface film layer preferably contains calcium carbonate, titanium dioxide or barium sulfate pigment.

The inorganic pigment for the substrate sheet is employed preferably in an amount of 8 to 65% by weight. If the amount of the inorganic pigment is less than 8% by weight, a satisfactory paper-like film cannot be obtained and the resultant substrate sheet exhibits an unsatisfactory absorption of the coating liquid. If the amount of the inorganic pigment is more than 65% by weight, the resultant substrate sheet has an unsatisfactory mechanical strength.

The substrate sheet usable for the present invention preferably has a thickness of 10 to 200 μm and a weight of 10 to 200 g/m$^2$.

However, the substrate sheet is not restricted to those having the above-mentioned thickness and weight.

EXAMPLES

The present invention will be further explained by the following examples which are merely representative and do not restrict the scope of the present invention in any way.

In the examples and comparative examples, the word "part" refers to —part by weight—.

Example 1

An aqueous dispersion (1) having the following composition was prepared.

| Component | Part |
|---|---|
| Amorphous silica A(*)1 | 100 |
| Silanol group-containing, modified polyvinyl alcohol (*)2 | 45 |
| Water | 660 |

Note:
(*)1 . . . Trademark: Mizukasil P705
Manufacturer: Mizusawa kagaku K.K.
Oil absorption: 280 ml/100 g
Average particle size: 1.5 μm
(*)2 . . . Trademark: R-1130
Polymerization degree: 1700
Manufacturer: Kuraray K.K.

The aqueous coating dispersion was coated on a front surface of an extrude-oriented polyolefin sheet (trademark: Yupo FPG-110 made by OJIYUKA GOSEISHI K.K.) having a thickness of 110 μm and dried-solidified to form an ink-receiving layer having a dry weight of 40 g/m$^2$. A hot melt ink thermal transfer recording sheet was obtained.

Example 2

To produce a hot melt ink thermal transfer recording sheet, the same procedures as in Example 1 were carried out with the following exceptions.

In the preparation of the aqueous coating dispersion, the silica A was replaced by amorphous silica B (trademark: Mizukasil P802, made by Mizusawa Kagaku K.K., oil absorption: 240 ml/100 g, average particle size: 2.4 μm).

Example 3

To produce a hot melt ink thermal transfer recording sheet, the same procedures as in Example 1 were carried out with the following exceptions.

In the preparation of the aqueous coating dispersion, the silica A was replaced by an amorphous silica C (trademark: Mizukasil P709, made by Mizusawa Kagaku K.K., oil absorption: 260 ml/100 g, average particle size: 4.0 μm).

Comparative Example 1

To produce a hot melt ink thermal transfer recording sheet, the same procedures as in Example 1 were carried out with the following exceptions.

In the preparation of the aqueous coating dispersion, the silica A was replaced by a silica D (trademark: Fineseal×45, made by Tokuyama Soda K.K., oil absorption: 250 ml/100g, average particle size: 4.5 μm).

Comparative Example 2

To produce a hot melt ink thermal transfer recording sheet, the same procedures as in Example 1 were carried out with the following exceptions.

In the preparation of the aqueous coating dispersion, the silica A was replaced by a silica E (trademark: Mizukasil P603, made by Mizusawa Kagaku K.K., oil absorption: 115 ml/100 g, average particle size: 2.2 μm).

Comparative Example 3

To produce a hot melt ink thermal transfer recording sheet, the same procedures as in Example 1 were carried out with the following exceptions.

In the preparation of the aqueous coating dispersion, the silica A was replaced by a silica F (trademark: Silica #470, made by Fuji Devidson Kagaku K.K., oil absorption: 180 ml/100 g, average particle size: 12 μm).

Comparative Example 4

To produce a hot melt ink thermal transfer recording sheet, the same procedures as in Example 1 were carried out with the following exceptions.

In the preparation of the aqueous coating dispersion, the silica A was replaced by a silica G (trademark: Silica #310, made by Fuji Devidson Kagaku K.K., oil absorption: 310 ml/100 g, average particle size: 1.5 μm).

Comparative Example 5

To produce a hot melt ink thermal transfer recording sheet, the same procedures as in Example 1 were carried 10 out with the following exceptions.

In the preparation of the aqueous coating dispersion, the silanol group-containing, modified polyvinyl alcohol R-1130 was replaced by another silanol group-containing modified polyvinyl alcohol having a polymerization degree of 500.

Comparative Example 6

To produce a hot melt ink thermal transfer recording sheet, the same procedures as in Example 1 were carried out with the following exceptions.

In the preparation of the aqueous coating dispersion, the silanol group-containing, modified polyvinyl alcohol R-1130 was replaced by a non-modified polyvinyl alcohol (trademark: PV A-117, made by Kuraray K.K., polymerization degree: 1700)

Comparative Example 7

To produce a hot melt ink thermal transfer recording sheet, the same procedures as in Example 1 were carried out with the following exceptions.

In the preparation of the aqueous coating dispersion, the silanol group-containing, modified polyvinyl alcohol R-1130 was replaced by a non-modified polyvinyl alcohol (trademark: PV A-105, made by Kuraray K.K., polymerization degree: 500)

Tests

The hot melt ink thermal transfer recording sheets of Examples 1 to 3 and Comparative Examples 1 to 7 were moisture-conditioned in accordance with JIS P8111, and then test-printed with a printer-fixed test printing pattern by using a hot melt ink thermal transfer printer (trademark: CH-4104, made by Seiko Denshi K.K.).

Evaluation

The resultant prints were subjected to the following evaluations.

(1) Resistance to printing errors (missing and partial dots)

A low energy-applied printed portion was observed and evaluated as follows.

Class 3 . . . Excellent

2 . . . Slightly bad

1 . . . Bad

2) Bonding strength of ink-receiving layer

Class 2 . . . No removal was found on the ink-receiving layer

1 . . . A portion of the ink-receiving layer was removed.

The test results are shown in Table 1.

TABLE 1

| | Item | | | | | | |
|---|---|---|---|---|---|---|---|
| | Silica pigment | | | Polyvinyl alcohol | | Test result | |
| Example No. | Type | Oil absorption (ml/100 g) | Average particle size (μm) | Type | Polymerization degree | Resistance to printing errors | Bonding strength of ink-receiving layer |
| Example | | | | | | | |
| 1 | Silica A | 280 | 1.5 | Modified | 1700 | 3 | 2 |
| 2 | Silica B | 240 | 2.4 | Modified | 1700 | 3 | 2 |
| 3 | Silica C | 260 | 4.0 | Modified | 1700 | 3 | 2 |
| Comparative Example | | | | | | | |
| 1 | Silica D | 250 | 4.5 | Modified | 1700 | 2 | 2 |
| 2 | Silica E | 115 | 2.2 | Modified | 1700 | 2 | 2 |
| 3 | Silica F | 180 | 12.0 | Modified | 1700 | 1 | 2 |
| 4 | Silica G | 310 | 1.5 | Modified | 1700 | 3 | 1 |
| 5 | Silica A | 280 | 1.5 | Modified | 500 | 3 | 1 |
| 6 | Silica A | 280 | 1.5 | Non-modified | 1700 | 3 | 1 |
| 7 | Silica A | 280 | 1.5 | Non-modified | 500 | 3 | 1 |

We claim:

1. A hot melt ink thermal transfer recording sheet comprising:

a multi-layered substrate sheet comprising a plurality of thermoplastic resin films laminated on each other, each comprising, as a principal component, a mixture of a polyolefin resin with an inorganic pigment, and each oriented monoaxially or diaxially; and an ink-receiving layer formed on a surface of the substrate sheet and comprising, as a principal component, a mixture of a resinous material with an inorganic pigment, wherein the resinous material for the ink-receiving layer comprises a modified polyvinyl alcohol provided with silanol groups and having a degree of polymerization of 1,000 to 2,000, and the inorganic pigment for the ink-receiving layer comprises fine amorphous silica particles having an oil absorption of 200 to 300 ml/100 g determined in accordance with Japanese Industrial Standard (JIS) K5101 and an average particle size of 0.5 to 4.0 μm determined by the Coulter Counter method.

2. The hot melt ink thermal transfer recording sheet as claimed in claim 1, wherein in the ink-receiving layer, the silanol group-containing modified polyvinyl alcohol is present in an amount of 1 to 70 parts by weight per 100 parts by weight of the fine amorphous silica.

* * * * *